United States Patent [19]

Feldman

[11] 3,952,853

[45] Apr. 27, 1976

[54] VERTICAL SHIFT MECHANISM

[75] Inventor: Edward Feldman, Teaneck, N.J.

[73] Assignee: Litton Business Systems, Inc., Pinebrook, N.J.

[22] Filed: Oct. 29, 1974

[21] Appl. No.: 518,394

[52] U.S. Cl. ..... 197/55; 335/234

[51] Int. Cl.[2] ..... B41J 1/32

[58] Field of Search ..... 46/234, 235; 178/34; 197/55; 335/229, 230, 232, 234

[56] References Cited

UNITED STATES PATENTS

| | | | |
|---|---|---|---|
| 1,552,676 | 9/1925 | Carpenter | 335/234 |
| 3,465,329 | 9/1969 | Abel | 178/34 UX |
| 3,608,692 | 9/1971 | Henry | 197/55 |
| 3,631,366 | 12/1971 | Ugon | 335/234 X |
| 3,743,073 | 7/1973 | Perez | 197/55 |

FOREIGN PATENTS OR APPLICATIONS

| | | | |
|---|---|---|---|
| 1,270,691 | 6/1968 | Germany | 335/230 |

*Primary Examiner*—Harland S. Skogquist
*Attorney, Agent, or Firm*—Robert F. Rotella; Norman Friedman; Stephen A. Roen

[57] ABSTRACT

A pair of electromagnets, each including pole faces separated by an air gap, cooperate with a permanent bar magnet, the ends of which extend into the electromagnet air gaps. Polarization of the electromagnets causes the bar magnet to shift into four possible positions thereby shifting a coupled print head to bring one of its four type bands into printing position.

7 Claims, 4 Drawing Figures

VERTICAL SHIFT MECHANISM

BACKGROUND OF THE INVENTION

This invention relates to high speed printing mechanisms particularly of the type utilizing a cylindrical print head or wheel carrying a number of bands of type characters. Present day business machines require the use of a large number of type characters covering a range of alphanumeric and symbolic characters. For maximum efficiency it is common to arrange these characters in a plurality of bands around the periphery of a circular or cylindrical print wheel.

It has been a problem in the past to achieve rapid shifting of the print wheel so that the appropriate band containing the desired character is selected and positioned in proper relation to the platen for printing. An example of one solution to this problem is disclosed in U.S. Pat. No. 3,743,073 for a "Print Head Shifting Mechanism" assigned to the assignee of the present invention.

The present invention is characterized by a reduction in the number of elements required to perform shifting of the print head while, at the same time, increasing the speed of performance.

SUMMARY OF THE INVENTION

A pair of electromagnets is associated with a permanent bar magnet which is coupled through a linkage to a print head provided with four type bands. By suitably polarizing the electromagnets the print head may be shifted to locate any one of the four bands in position for subsequent printing.

DESCRIPTION OF THE PREFERRED EMBODIMENT

Figure 1:
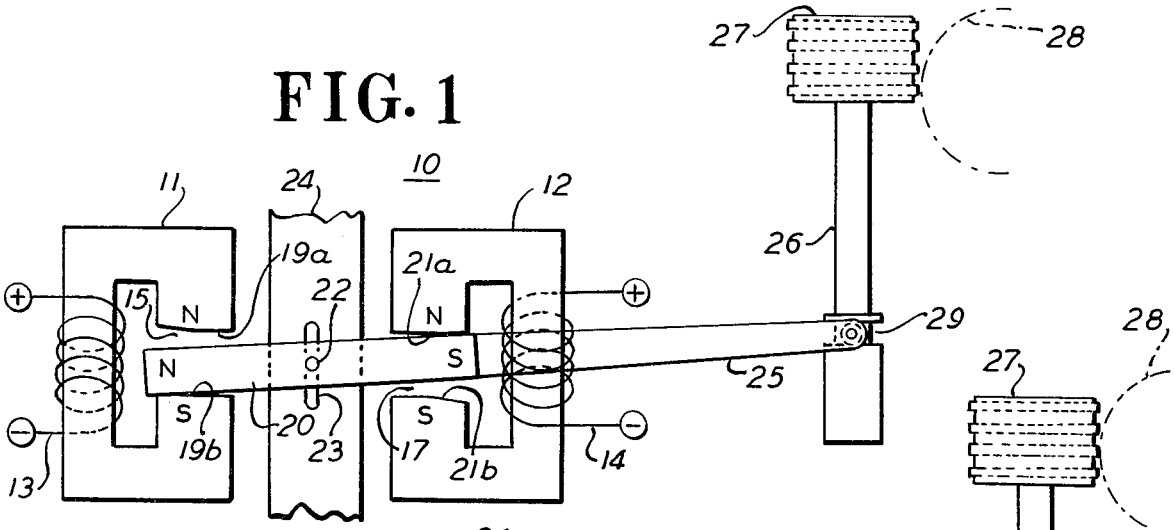
FIG. 1 is a side view of the electromagnet shifting mechanism in conjunction with the print head in a first shift position.

Referring to FIG. 1, the print head shifting mechanism 10, includes a pair of electromagnets 11, 12 each including a core member of magnet-grade metal and an energizing wire coil winding 13,14. The core of each electromagnet is provided with an air gap 15,17 of sufficient length to permit a permanently magnetized bar magnet 20 to move therein. Bar magnet 20 is provided at its center of gravity point with a fixed pin 22 which extends perpendicular to the axis of the bar magnet and engages a slot 23 of a frame member 24.

Pin 22 extends through slot 23 and is rigidly fastened to a shift arm 25, coupled to print head shaft 26. Thus any motion of bar magnet 20 will cause a corresponding motion in shift arm 25.

In each electromagnet 11, 12 the gap areas 15,17 are defined by upper and lower poles **19*a*, 19*b*, and 21*a*, 21*b*, respectively. The faces of each of the four poles include a straight, mutually parallel portion and an angled portion. In the drawing, the portion of the four pole faces 19*a*, 19*b*, 21*b*, 21*b* which are closest to the frame 24** are all parallel to each other and substantially perpendicular to the axis of the base leg portion of each electromagnet around which the coils are wound.

In addition, the portion of the four pole faces **19*a*, 19*b*, 21*a*, 21*b* which are farthest away from frame 24 are inclined with respect to the first-mentioned pole face portions. Thus, in electromagnet 11, the portion of pole faces 19*a* and 19*b* closest to coil 13 are sloped upward and downward, respectively. Similarly, in electromagnet 12, the portion of pole faces 21*a*, 21*b* closest to coil 14** are sloped upward and downward, respectively.

This arrangement of the pole faces permits the orientation of bar magnet 20 in any one of four positions to thereby shift the print head to a selected type band in the following manner:

Coils 13 and 14 are wound about the cores of electromagnets 11 and 12 and are appropriately activated to control the direction of magnetic flux flowing within the magnetic circuit formed by the cores themselves and the associated air gaps 15, 17. By changing the direction of current flow into each coil by suitable polarization of a direct-current voltage source connected across the coil windings, the direction of magnetic flux can be controlled and the magnetic polarity of the poles governed. For example, in electromagnet 11, a d-c voltage source (not shown) may be connected with its positive terminal to the top lead of coil 13 and its negative terminal to the bottom lead of the coil will cause electric current to flow in a direction causing magnetic flux to flow from pole face **19*a* to pole face 19*b***.

By convention, when magnetic flux flows out of one pole into another pole, the former is designated as the North pole and the latter as the South pole. Thus, pole **19*a* is the North pole and pole 19*b* is the South pole. Reversal of the polarity of the voltage source will cause a corresponding reversal in the North and South poles of electromagnet 11. Similarly, the magnetic polarity of the poles of electromagnet 12 can be controlled by appropriate polarization of a d-c voltage source connected across coil 14**.

Bar magnet 20, by virtue of being permanently magnetized, has a fixed North pole at one end and a fixed South pole at the other end and is so labeled in the drawing. As is well-known, when two magnets are placed in close proximity, oppositely polarized poles will be mutually attracted and similarly polarized poles will be mutually repelled. Accordingly, as the polarity of the poles of the electromagnets is varied, bar magnet 20 may be made to shift in correspondence therewith.

Thus, in FIG. 1, pole **19*a* of electromagnet 11 and pole 21*a* of electromagnet 12 are polarized as North poles by current flowing into the top leads of coils 13 and 14 from the positive terminal of a d-c voltage source. The North pole of bar magnet 20 is repelled away from the North pole 19*a* and the South pole of bar magnet 20 is attracted towards the North pole 21*a* of electromagnet 12. Bar magnet 20**, therefore, assumes a position in which its longitudinal axis points to the upper right or lower left.

Since the "inner" faces of the poles **19*b* and 21*a* of the electromagnets are inclined and are parallel to the axis of bar magnet 20**, the latter is firmly seated on these faces and is rigidly fixed in position.

Once bar magnet 20 is shifted, it is no longer necessary to maintain the coils 13, 14 electrically activated. Since the cores of electromagnets 11, 12 are made of magnetic metal, permanent magnet 20 will provide the necessary magnetic holding force to maintain its position until a subsequent shift in orientation is needed.

Shift arm 25 being rigidly connected to bar magnet 20 will also be shifted in orientation in correspondence with the orientation of the latter. The end of shift arm 25 is coupled to the print head shaft 26 through a yoke arrangement 29 which permits shaft 26 to translate in a longitudinal direction in accordance with the movement of magnet 26 as well as to rotate.

The rotation of shaft 26 is for the purpose of rotating the associated print head 27 into position for printing the desired character against the paper supporting platen 28. A stepping motor and control system such as is disclosed in the aforementioned patent may be employed for selection of the type character to be printed. Furthermore, impact means of the type disclosed in said patent may be used to cause the print head to strike a record medium resting against the platen for printing the character.

Figure 2:
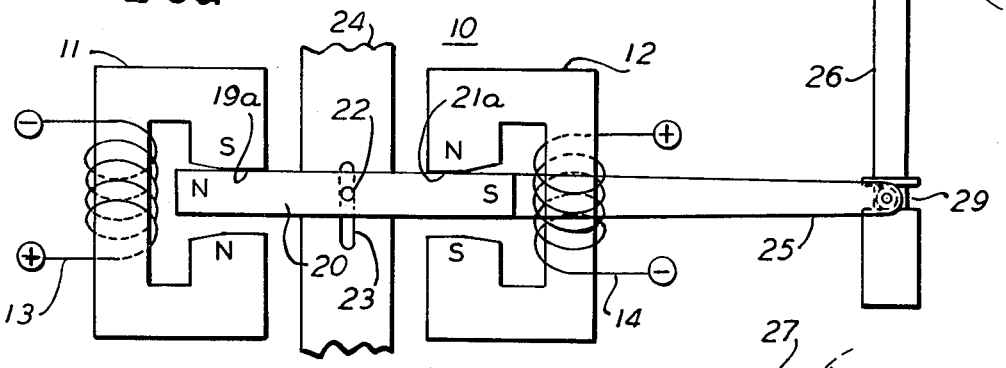
FIG. 2 is a side view of the apparatus in FIG. 1 with the print head in a second shift position.

In FIG. 2, electromagnets 11 and 12 have been polarized so that pole face 19*a* of the former is the South pole and pole face 21*a* of the latter is the North pole. Bar magnet 20 is thus attracted to the two upper poles of the electromagnets 11, 12 and assumes an upper horizontal position. Print head 27 is shifted so that the next-to-lowest type band is in printing position.

Figure 3:
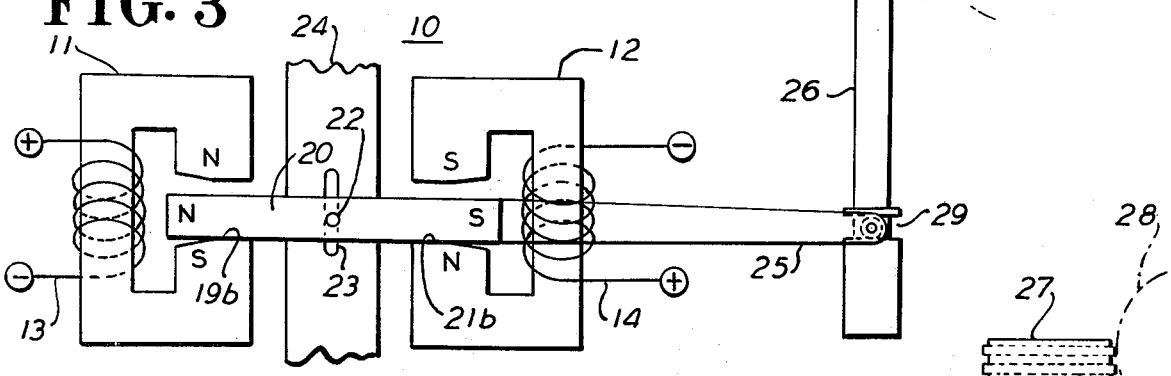
FIG. 3 is a side view of the apparatus in FIG. 1 with the print head in a third shift position.

Similarly, in FIG. 3, poles 19*b* and 21*b* are polarized as South and North poles, respectively. Bar magnet 20 is attracted to the two lower poles of electromagnets 11, 12 and print head 27 is shifted to position the next-to-highest type band for printing.

Figure 4:
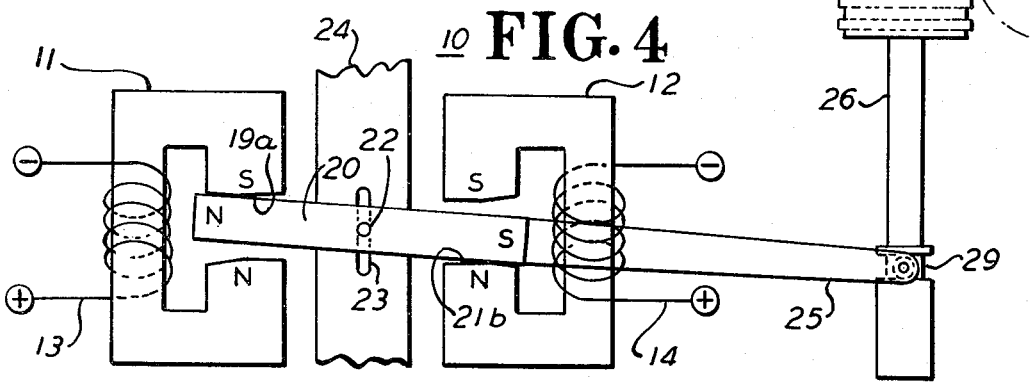
FIG. 4 is a side view of the apparatus in FIG. 1 with the print head in a fourth shift position.

Finally, in FIG. 4, pole 19*a* of electromagnet 11 is polarized South and pole 21*b* of electromagnet 12 is polarized North. Bar magnet 20 is shifted to the upper left and lower right, contacting the inner portions of the respective poles. Print head 27 is positioned so that its highest type band is adjacent the platen 28.

Control of the orientation of bar magnet 20 and the shifting of the print head 27 is achieved solely by the appropriate polarization of a source of electrical energy applied to coils 13 and 14. For example, a series of mechanical control relays may be interposed between a d.c. voltage source and the coils to select the polarity applied to the coil windings. Alternatively, an electronic switching network may be similarly employed for polarity control.

The amount of magnetic flux required to shift bar magnet 20 depends in part upon the length of the air gap between the opposing pole faces 19*a*–19*b* and 21*a*–21*b*, the number of turns in and the inductance of the coils 13, 14, the amount of current flowing through the coils, the cross-sectional area of the pole faces as well as the magnetic field strength of permanent magnet 20.

Magnet 20 may also be constructed as an electromagnet with a suitable winding coupled to an electrical source to establish either a fixed or selectable North-South polarity.

Having described the invention, it will be apparent that many modifications will be obvious to one skilled in the art and, consequently, the scope of the invention is to be measured solely by the following claims:

What is claimed is:

1. A mechanism for shifting a print head containing a plurality of type bands into a number of operative positions comprising:

electromagnet means comprising core means and winding means;

said winding means being selectively coupled to a source of electrical energy for establishing a magnetic field;

actuating means for causing variations in said magnetic field;

a shifting element comprising magnet means in operative proximity to said magnetic means and being moved in response to said magnetic field;

said electromagnet means comprising a pair of electromagnets each having a core including a gap region defined by a pair of separated opposed pole faces and a winding;

said magnet means comprising a member having a first portion with an associated first magnetic polarity extending into the gap region of a first of said electromagnets and a second portion with an associated second magnetic polarity extending into the gap region of a second of said electromagnets; and a print head coupled to said shifting element;

said shifting element being movable into any one of a plurality of positions in accordance with variations in said magnetic field; whereby said print head is correspondingly moved into any one of a plurality of positions.

2. A mechanism for shifting a print head as set forth in claim 1, wherein:

said electromagnet gap regions are opposed to each other and equidistant from a predetermined plane.

3. A mechanism for shifting a print head as set forth in claim 2, wherein:

each of said electromagnet pole faces include a first portion mutually parallel to the corresponding first portions of said other pole faces and a second portion inclined with respect to said first portion;

the second portion of one electromagnet pole face being parallel to the second portion of another opposite, alternate electromagnet pole face.

4. A mechanism for shifting a print head as set forth in claim 3, wherein:

said member is movable into a plurality of positions determinable by the respective magnetic polarity of each of said pole faces and the polarity associated with the first and second portions of said member.

5. A mechanism for shifting a print head as set forth in claim 4, wherein:

said member comprises a longitudinally extending bar the end portions thereof being adaptable to make contact with either the first or second portions of said electromagnet pole faces.

6. A mechanism for shifting a print head as set forth in claim 5, wherein:

said bar is permanently magnetized;

said source of electrical energy being polarized to thereby control the polarity of said pole faces in accordance with the direction of current flow in each of said windings.

7. A mechanism for shifting a print head as set forth in claim 6, wherein:

said bar is pivotable substantially about its center point for permitting the end portions thereof to contact alternate opposite second portions of said electromagnet pole faces; and said bar is translatable parallel to its longitudinal axis to permitting the end portions thereof to contact alternate opposite first portions of said electromagnet pole faces;

linkage means for coupling said print head to said bar; whereby the type bands on said print head are brought into printing position in accordance with the movement of said bar.

* * * * *

UNITED STATES PATENT OFFICE

CERTIFICATE OF CORRECTION

PATENT NO. : 3,952,853

DATED : October 29, 1974

INVENTOR(S) : Edward Feldman

It is certified that error appears in the above-identified patent and that said Letters Patent are hereby corrected as shown below:

Column 1, line 67, the first "21b" should be --21a--

Signed and Sealed this

Thirty-first Day of August 1976

[SEAL]

*Attest:*

RUTH C. MASON
*Attesting Officer*

C. MARSHALL DANN
*Commissioner of Patents and Trademarks*